US010648186B2

(12) United States Patent
Bailie

(10) Patent No.: US 10,648,186 B2
(45) Date of Patent: May 12, 2020

(54) RAMP AND PLATFORM ASSEMBLY AND INTERFACE THEREOF

(71) Applicant: Homecare Products, Inc., Algona, WA (US)

(72) Inventor: David A. Bailie, Kent, WA (US)

(73) Assignee: Homecare Products, Inc., Algona, WA (US)

( * ) Notice: Subject to any disclaimer, the term of this patent is extended or adjusted under 35 U.S.C. 154(b) by 0 days.

(21) Appl. No.: 15/797,699

(22) Filed: Oct. 30, 2017

(65) Prior Publication Data

US 2018/0119436 A1 May 3, 2018

Related U.S. Application Data

(62) Division of application No. 13/789,286, filed on Mar. 7, 2013, now Pat. No. 9,803,381.

(51) Int. Cl.

| | |
|---|---|
| ***E04G 7/28*** | (2006.01) |
| ***E04G 7/24*** | (2006.01) |
| ***E04G 7/08*** | (2006.01) |
| ***E04G 5/06*** | (2006.01) |
| ***E04G 7/20*** | (2006.01) |
| ***E04F 11/00*** | (2006.01) |
| ***E04F 11/18*** | (2006.01) |

(52) U.S. Cl.

CPC ..... *E04G 7/24* (2013.01); *E04F 11/002* (2013.01); *E04F 11/1812* (2013.01); *E04G 5/06* (2013.01); *E04G 7/08* (2013.01); *E04G 7/20* (2013.01); *E04G 7/28* (2013.01); *E04F 11/18* (2013.01); *E04F 2011/007* (2013.01)

(58) Field of Classification Search

CPC .... E04G 7/20; E04G 7/24; E04G 7/28; Y10T 16/53625; Y10T 403/55; B65G 69/30

See application file for complete search history.

(56) References Cited

U.S. PATENT DOCUMENTS

| | | | |
|---|---|---|---|
| 1,345,012 | A | 6/1920 | Jones |
| 1,358,951 | A | 11/1920 | Helmich |
| 1,555,847 | A | 10/1925 | Hudson |
| 1,588,810 | A | 6/1926 | Rudolph et al. |
| 1,716,904 | A | 6/1929 | Sideritis |
| 2,169,102 | A | 8/1939 | Lemont |
| 2,335,046 | A | 11/1943 | Droeger |

(Continued)

FOREIGN PATENT DOCUMENTS

| | | | |
|---|---|---|---|
| FR | 1245325 | A | 11/1960 |

*Primary Examiner* — Colleen M Chavchavadze
(74) *Attorney, Agent, or Firm* — Polsinelli PC

(57) ABSTRACT

In one embodiment of the present disclosure, a ramp and platform interface, includes a platform side defining one or more slots, the upper end of the one or more slots defined by a downwardly and inwardly extending lip; at least one support flange including a body, a lip disposed at the top edge of the body, and a flange section outwardly extending from the body, wherein the at least one support flange is selectively mounted to the platform side via the one or more slots; and a ramp section defining a support surface on a top side thereof and one or more support flange engagement structure on the bottom side thereof, wherein the ramp section is disposed in a supporting relationship with the platform side via cooperation of the flange section and the support flange engagement structure.

16 Claims, 5 Drawing Sheets

(56) References Cited

U.S. PATENT DOCUMENTS 2,483,341 A 9/1949 Haas
2,571,337 A 10/1951 Burnham
2,620,839 A 12/1952 Tyler
2,676,044 A 4/1954 Gorman et al.
3,043,407 A * 7/1962 Marryatt ..... E04C 2/08 52/177
3,053,930 A 9/1962 Mallanik et al.
3,065,010 A 11/1962 Scheneman
3,074,241 A 1/1963 Cahill et al.
3,079,186 A 2/1963 Williams
3,100,556 A * 8/1963 De Ridder ..... F16B 5/008 52/283
3,208,227 A 9/1965 Armbrust
3,348,459 A * 10/1967 Harvey ..... E01C 9/083 404/35
3,462,021 A 8/1969 Hawke et al.
3,572,224 A * 3/1971 Perry ..... E01C 9/083 404/40
3,677,582 A 7/1972 Flick
3,693,754 A 9/1972 Butler
3,742,911 A * 7/1973 Lehe ..... A01K 1/0151 119/529
3,808,757 A 5/1974 Greenwood
3,891,052 A 6/1975 Lee, Sr. et al.
3,984,891 A * 10/1976 Weinmann ..... B65G 69/30 14/69.5
4,074,537 A 2/1978 Gronlie
4,092,079 A 5/1978 Swanson
4,126,006 A * 11/1978 Lewis ..... E02B 3/068 405/220
4,263,984 A 4/1981 Masuda et al.
4,314,771 A 2/1982 Lambert
4,362,423 A 12/1982 Miles
4,468,901 A * 9/1984 Henderson ..... E04F 11/025 52/184
4,617,775 A 10/1986 Padrun
4,734,062 A 3/1988 Goto
4,759,162 A 7/1988 Wyse
4,778,726 A 10/1988 Viles
4,877,672 A * 10/1989 Shreiner ..... A47L 23/26 428/156
5,062,181 A * 11/1991 Bobrowski ..... E05D 3/122 16/234
5,326,337 A 7/1994 Pardella
5,329,667 A * 7/1994 Erskine ..... E05D 1/04 16/269
5,337,451 A * 8/1994 Goossens ..... E05D 3/122 16/354
5,347,672 A * 9/1994 Everard ..... A61G 3/061 14/69.5
5,370,560 A 12/1994 Ito
5,409,122 A 4/1995 Lazarus
5,513,472 A * 5/1996 Olsen ..... A47L 23/24 52/177
5,584,606 A 12/1996 Hoogasian, Jr.
5,653,459 A 8/1997 Murphy
6,116,437 A 9/2000 Rowe
6,217,259 B1 * 4/2001 Godbersen ..... E02B 3/068 405/218
6,481,036 B1 * 11/2002 Duvall ..... H02G 9/02 104/275
6,585,207 B2 7/2003 Ibbitson et al.
6,810,995 B2 11/2004 Warlord
7,241,078 B2 7/2007 Surges
7,406,801 B2 * 8/2008 Zeng ..... E04F 15/06 52/177
7,415,801 B2 * 8/2008 Zeng ..... E04F 15/06 52/177
7,526,826 B2 * 5/2009 Bailie ..... B65G 69/30 14/69.5
7,794,178 B2 * 9/2010 Golden ..... E02B 3/068 114/263
8,028,494 B2 10/2011 Denn et al.
8,146,941 B2 * 4/2012 Steins ..... B62D 63/061 14/71.1
8,272,184 B2 9/2012 Cech
8,695,140 B1 * 4/2014 Zyadet ..... E01C 11/222 14/69.5
9,464,443 B2 * 10/2016 Martensson ..... E04F 15/02
9,775,326 B1 * 10/2017 MacNeil ..... A01K 1/035
2002/0078513 A1 * 6/2002 Schouest ..... B60P 1/43 14/69.5
2011/0188984 A1 8/2011 Hofer
2011/0198153 A1 8/2011 Dufour et al.
2011/0262219 A1 10/2011 van Walraven
2012/0180416 A1 * 7/2012 Perra ..... E04F 15/02 52/309.1
2014/0318895 A1 * 10/2014 Birk ..... E04G 3/22 182/222

* cited by examiner

RAMP AND PLATFORM ASSEMBLY AND INTERFACE THEREOF

CROSS-REFERENCE TO RELATED APPLICATION

This application is a division of U.S. patent application Ser. No. 13/789,286, filed Mar. 7, 2013, now U.S. Pat. No. 9,803,381, the disclosure of which is incorporated by reference herein in its entirety.

BACKGROUND

Ramps and platforms are becoming increasingly common, due primarily to the recent passage of the Americans with Disabilities Act (ADA) requiring public buildings to be designed or modified to provide wheel chair access. These ramps and platforms assist those people confined to wheelchairs or who use walkers by providing a suitable pathway or rampway to the entrances of public and private buildings and stores, which may be at elevations above or below ground level. Since each site may be generally different from other sites, there is a need for ramp and platform assemblies that are modular in construction, and designed to minimize the cost and assembly time of at-site assembly.

Modular ramp and platform assemblies generally include deck surfaces, support posts, and handrails. These modular assemblies can be configured to provide ramping and horizontal deck surfaces to provide access, for example, if a user needs to travel from elevation A to elevation B, but is not able to traverse stairs or a steep slope to get there.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with another aspect of the present disclosure, a ramp and platform interface is provided. The interface includes a platform side defining one or more slots, the upper end of the one or more slots defined by a downwardly and inwardly extending lip, and at least one support flange each including a body, a lip disposed at the top edge of the body, and a flange section outwardly extending from the body. In some embodiments, the at least one support flange is selectively mounted to the platform side via the one or more slots. The interface also includes a ramp section that defines a support surface on a top side thereof and one or more support flange engagement structure on the bottom side thereof. In some embodiments, the ramp section is disposed in a supporting relationship with the platform side via cooperation of the flange section and the support flange engagement structure.

In another embodiment of the present dislcosure, a ramp and platform assembly is provided. The assembly includes a platform having an elevated deck and including a platform side defining one or more slots, the upper end of the one or more slots defined by a downwardly and inwardly extending lip, a ramp including a ramp section defining a support surface on a top side thereof and one or more support flange engagement structures on the bottom side thereof, and at least one support flange including a body, a lip disposed at the top edge of the body, and a flange section outwardly extending from the body, wherein the at least one support flange is selectively mounted to the platform side via the one or more slots, wherein the ramp section is disposed in a supporting relationship with the platform side via cooperation of the flange section and the support flange engagement structure.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The detailed description set forth below in connection with the appended drawings where like numerals reference like elements is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

The following description sets forth one or more examples of a ramp and/or platform assembly and components thereof. Generally, embodiments described herein relate to modular ramp and platform assemblies that may include deck surfaces, support posts, and handrails. Additional embodiments relate to interfaces between components of the platform assembly, including, for example, the interface between the ramp section and the deck or platform section, the interface between the platform support posts and the handrail posts, etc.

As described in greater detail below, many of the components of the ramp and platform assembly may be formed from metal, for example, from extruded aluminum. Extruded aluminum construction generally reduces parts in the overall system, thereby reducing manufacturing and assembly costs, as well as operational noise generated by rattling part couplings. Moreover, extruded aluminum parts can be designed to achieve the same strength and stiffness requirements as steel construction, while having reduced weight over steel parts or parts made from other materials, allowing for improved ease of assembly and optimized part design.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well-known process steps have not been described in detail in order not to unnecessarily obscure various aspects of the present disclosure. It will be appreciated that embodiments of the present disclosure may employ any combination of features described herein.

Figure 1:
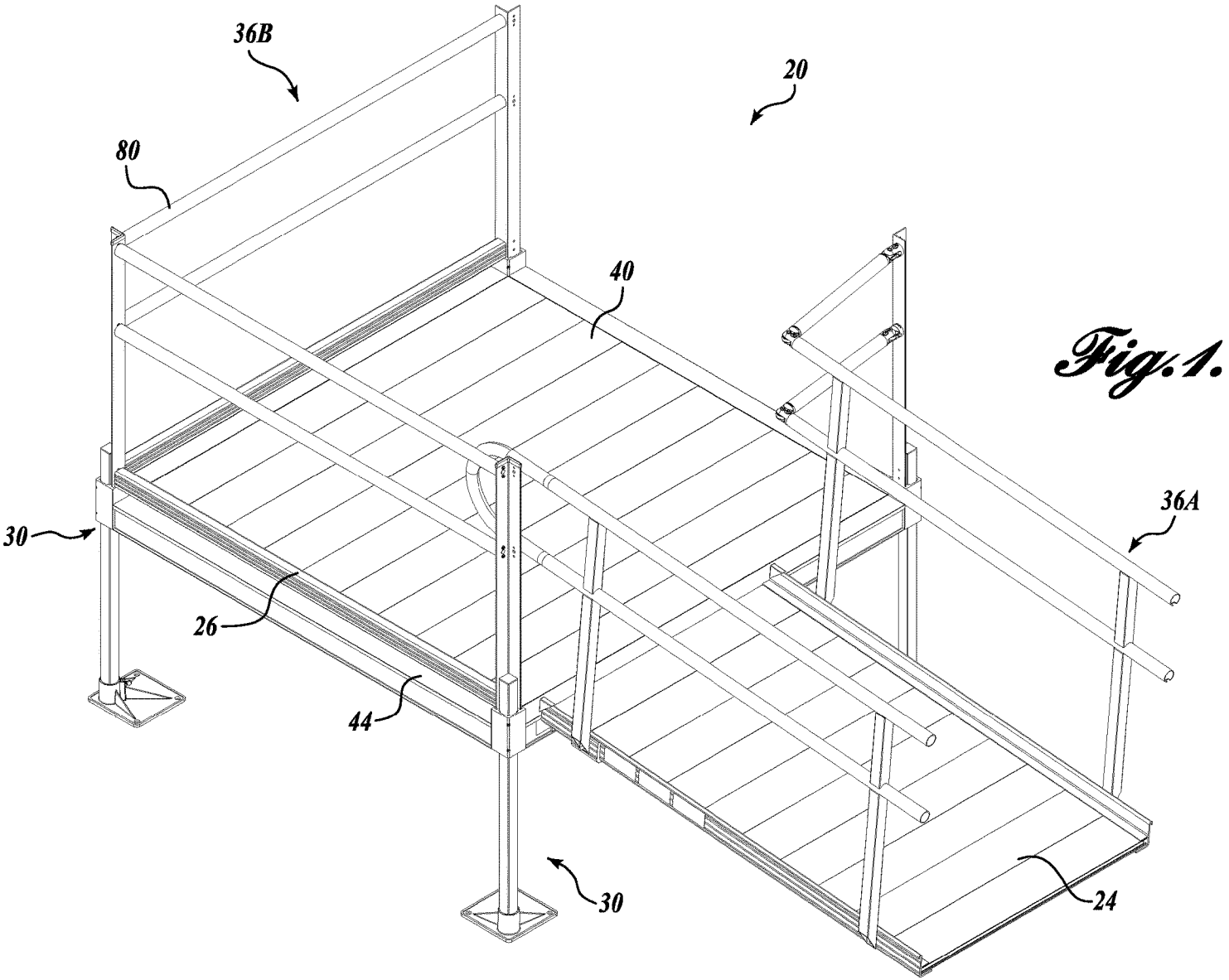
FIG. 1 is one example of a ramp and platform assembly in accordance with aspects of the present disclosure.

FIG. 1 illustrates an example of a modular ramp and platform assembly, generally designated 20, formed in accordance with aspects of the present disclosure. In the embodiment shown in FIG. 1, the assembly 20 includes a turn or an approximately 90 degree direction change for accessing an entrance/exit of a building (not shown). In that regard, the example of the assembly 20 depicted in FIG. 1 and described in detail below is assembled from one or more ramp sections 24 connected and supported by a "turn" platform 26 (hereinafter "platform 26"). The platform 26 is supported by a plurality of platform support posts or assemblies 30. The assembly 20 further includes a handrail 36 that extends around one or more sections of the perimeter of the assembly 20. In use, the assembly 20 spans from one surface (not shown) to a second, elevated surface (not shown), possibly over steps (not shown), for providing wheelchaired individuals and others a suitable pathway to an entrance of a building, such as a residential house, previously accessed by the steps.

In the embodiment shown, the handrail 36 is composed of an arrangement of ramp handrail sections 36A connected to the ramp sections 24 at the sides thereof, and platform handrail sections 36B connected to the platform 26 at the sides thereof. In some embodiments, the ramp handrail section 36A on the inside of the ramp section 24 with respect to the turn may be interconnected with the platform handrail 36B at the inside corner to form a continuous inside corner of the handrail 36.

Figure 2:
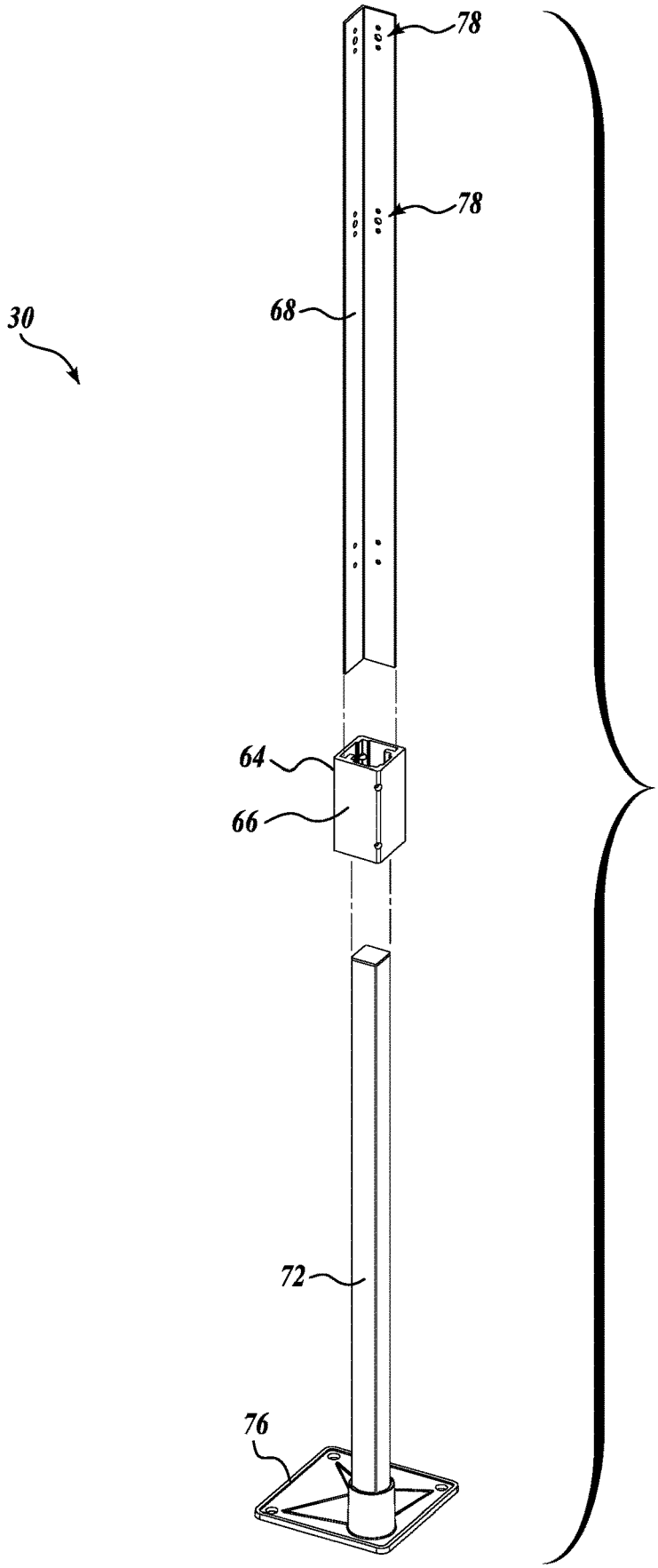
FIG. 2 is an exploded view of one example of a support post in accordance with aspects of the present disclosure.

Still referring to FIG. 1, the platform 26 will now be described in more detail. The platform 26 includes a substantially rectangular deck 40 and four side walls 44 that extend around the perimeter of the deck 40. The platform 26 is supported at its corners by a plurality of platform support assemblies 30. As best shown in FIG. 2, each platform support assembly 30 includes a connector 64. Generally described, the connector 64 has a rectangular tube-like body 66 and is configured to be fixedly secured to the sides 44 of the platform at the corners thereof (see FIG. 1). The connector 64 is configured to interface with, for example, an L-shaped handrail post 68 and, for example, a rectangular, tube-shaped support post 72. As will be described in more detail below, the connector 64 is configured to cooperatively receive both handrail post 68 and support post 72 in a sliding or telescoping manner in order to adjust the height of the platform 26 and/or the handrails 36, and can be fixedly secured to both handrail post 68 and support post 72. An optional footer 76 may be included for accepting one end of the support post 72 in a removably secure manner. In some embodiments, the handrail posts 68 may include one or more interfaces 78, such as apertures, brackets, and/or the like, configured for connection to one or more handrail members 80.

When the platform support assemblies 30 are assembled to support the platform 26, the connector 64 is positioned at the corners formed by sidewalls 44 and mounted thereto in a permanent or removable manner. In that regard, the connector 64 may include a connection interface, e.g., bolt holes, a mounting bracket, etc., configured to couple with the deck using appropriate fasteners. The support post 72 is routed through the connector 64 and is selectively coupled in a height adjustable manner to the connector 64. As such, the height of the platform 26 may be selectively adjusted for accommodating different installation applications and assembly sites. Similarly, the handrail post 68 is routed through the connector 64 and is selectively coupled in a height adjustable manner to the connector 64. As such, the height of the handrails may be selectively adjusted for accommodating different building codes, installation applications, and users.

Figure 3:
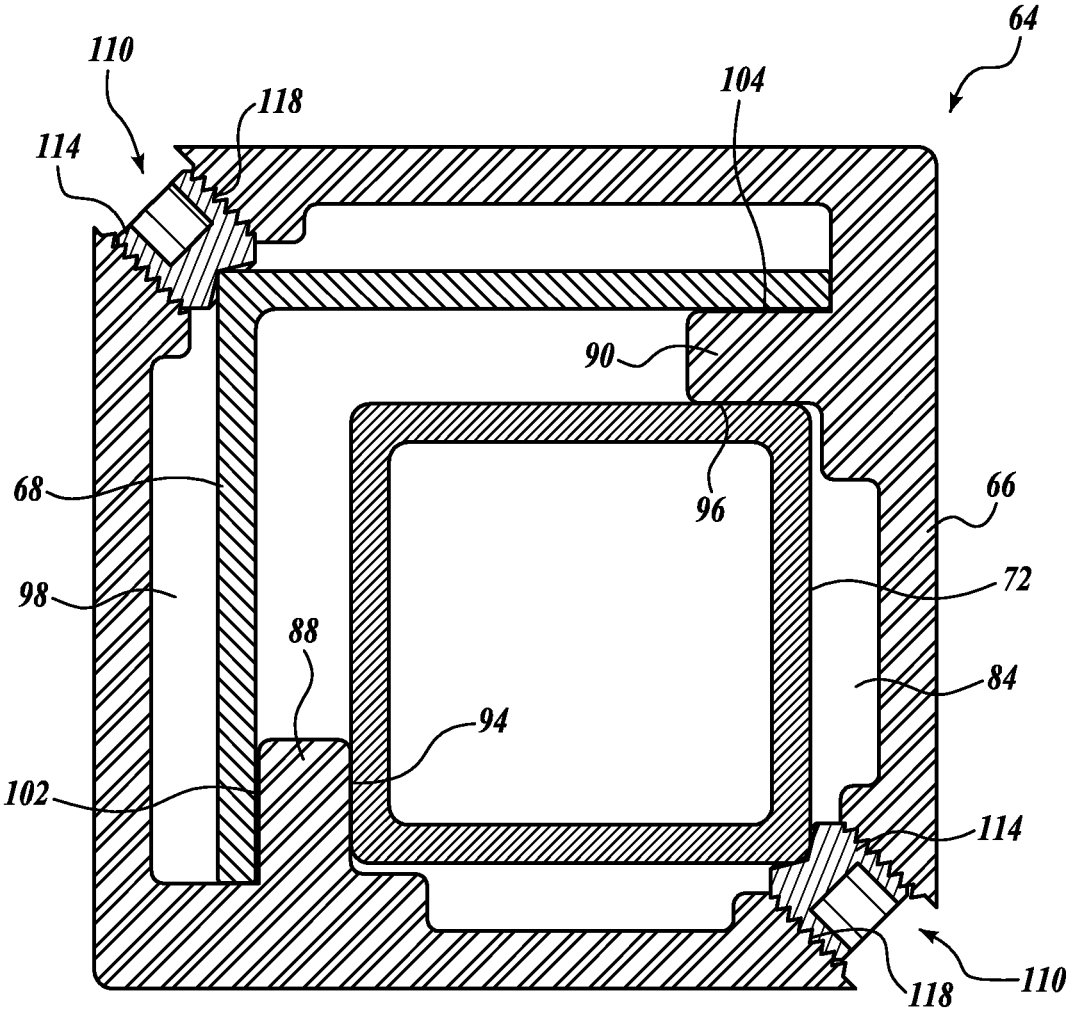
FIG. 3 is a horizontal cross-section of one example of a connector of the support post in accordance with aspects of the present disclosure.

Turning now to FIG. 3, there is shown a cross sectional view of one example of the connector 64 that may be practiced with embodiments of the present disclosure. As best shown in FIG. 3, the connector 64 includes a body 66 of generally rectangular cross section. The body 66 provides a first interior cavity section 84 configured to receive the support post 72. In the embodiment shown, the connector 64 includes interiorly extending flanges 88 and 90 mounted to or integrally formed with the body 66. The flanges 88 and 90 define first contact surfaces 94 and 96, respectively, which are oriented at right angles to one another. The first contact surfaces 94 and 96 are positioned and arranged so as to slidingly receive the support post 72.

The body 66 also provides a second interior cavity section 98 configured to receive the L-shaped handrail post 68. In the embodiment shown, the first and second flanges 88 and 90 define second contact surfaces 102 and 104, respectively, which are oriented at right angles to one another. The second contact surfaces 102 and 104 are positioned and arranged so as to slidingly receive the handrail post 68.

The connector 64 further includes first and second lock devices 110 disposed at diametrically opposed corners of the body 66. In the embodiment shown, the first and second lock devices 110 include thread pins 114 that threadably engage threaded bores 118. The thread pins 114 are sized and configured to interface with the corners of handrail post 68 and the support post 72, respectively, when such posts are received within the first and second cavity sections 84 and 98 of the body 66. In use, the thread pins 114 may be threadedly advanced inwardly toward the first interior cavity section 84 and the second interior cavity section 98 in order to contact the support post 72 and the handrail post 68, respectively, which, in turn, forces surfaces at the free end section of the handrail post 68 against second contact surfaces 102 and 104 and the free end section of the support post 68 against first contact surfaces 94 and 96. As such, selectively advancing the thread pins 114 can conditionally lock the posts 68 and 72 in place.

Figure 4:
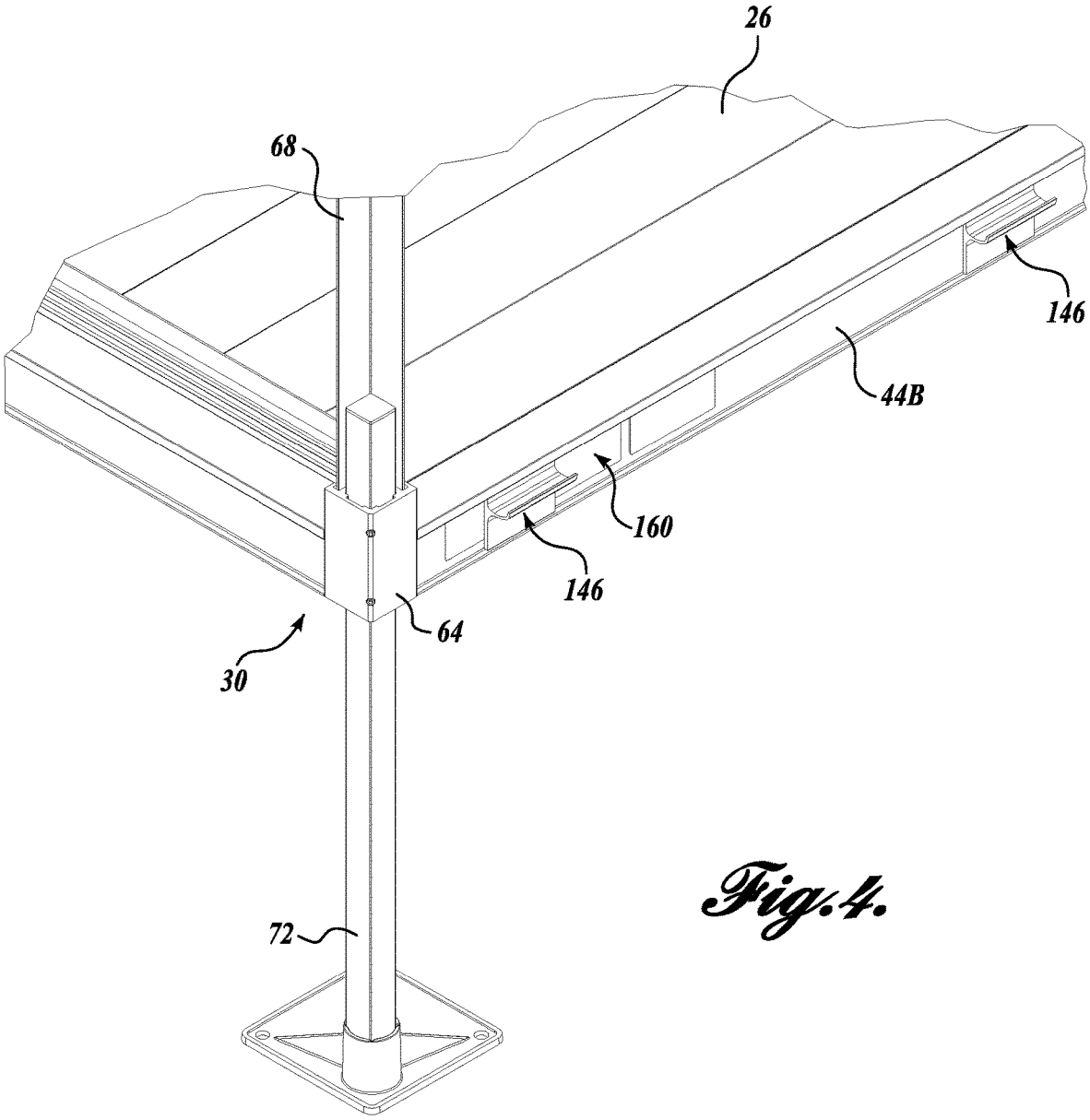
FIG. 4 is a partial perspective view detailing another aspect of the ramp and platform assembly.
Figure 5:
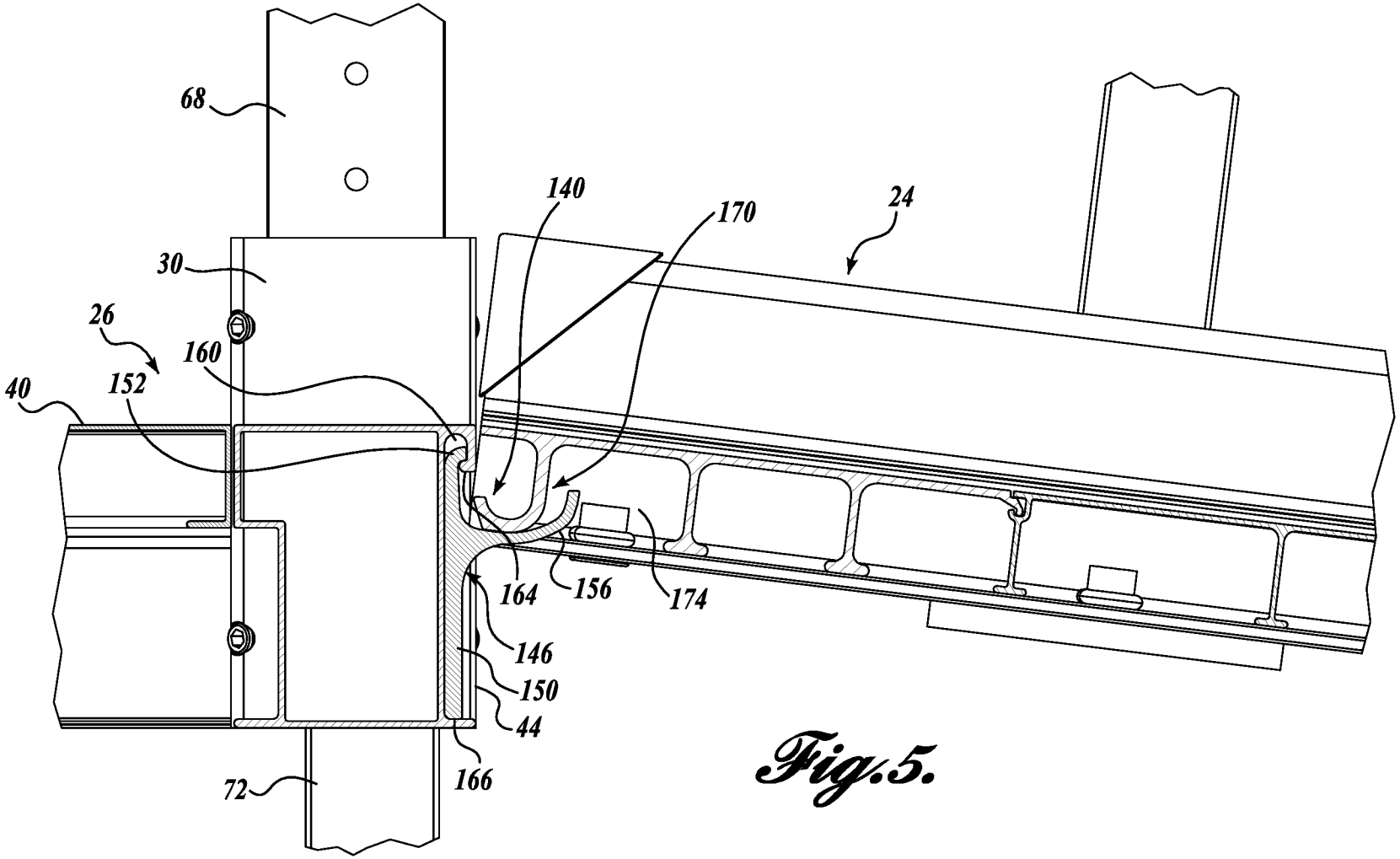
FIG. 5 is a partial cross-section view depicting one example of the interface between a ramp and a platform of the assembly of FIG. 1.

Another aspect of the present disclosure will now be described with reference to FIGS. 4 and 5. FIGS. 4 and 5 illustrate one example of an interface 140 between the ramp section 24 and the platform 26. As best shown in FIGS. 1 and 5, the upper end of the ramp section 24 is supported by the platform 26 via interface 140. In one embodiment, the interface 140 includes one or more support flanges 146 positioned along and extending outwardly from the side 44, such as side 44B, of the platform 26, as best shown in FIG. 4. The support flanges 146 can be integrally formed or selectively coupled to the sides 44 of the platform 26. Generally, the support flanges 146 are provided along a portion of the side 44 that corresponds in width to the ramp section 24.

In the embodiment shown in FIGS. 4 and 5, the support flanges 146 are distinct from the side 44 of the platform 26 and include a generally horizontally extending plate-like body 150. In some embodiments, the height of the plate-like body 150 generally corresponds to but is slightly shorter than the side 44 of platform 26. At the upper edge of the body 150 there is formed or otherwise mounted an outwardly and slightly downwardly curving lip 152. Extending outwardly and generally upwardly from the body 150 approximately mid height of the body 150 is a flange section 156.

To interface with the support flanges 146, the side 44B of the platform 26 includes either one contiguous slot 160 or a plurality of spaced apart slots. In either case, the upper end of the slot(s) 160 is formed by an inwardly extending lip 164, which is configured to cooperate with the lip 152 of each support flange body 152 in order to retain the support flange 146 therein. In particular, the slot 160 is generally sized to correspond in height with the support flange 146. To couple the support flange 146 with the slot 160, the support flange 146 can either be inserted from the side of the slot 160 or tilted into the slot 160 from a position facing the side 44. In either case, the lip 164 contacts the lip 152, thereby restricting the movement of the top of the support flange 146. Due to the corresponding height of the body 152, the bottom surface 166 of the body 150 is supported by the bottom of the slot 160 when the lips 152, 164 interact, thereby maintaining the position of the support flange 146 with respect to the side of the platform 26.

Once retained by the side 44*b*, the flange section 156 extends outwardly and upwardly from the body 150 in a generally arcuate manner. To interface with the flange section 156, the bottom of the ramp section 24 includes one or more laterally extending slots, apertures, or the like, generally designated 170. As such, structure 174 of the ramp section 24 adjacent the slots 170 is configured to rest against and be supported by the support flange section 156, as best shown in FIG. 5. Due to the interface configuration, the force exerted by the ramp section 24 on the flange section 156 aids in maintaining the support flange 146 in place with respect to the slot 160.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A ramp and platform interface between a platform having a substantially horizontal deck, wherein the deck is fixed in position and elevated compared to a reference ground surface, and a ramp configured for coupling to the platform, wherein the ramp is configurable to extend at a downward angle from the platform to a surface at another elevation or to a ground surface, the interface comprising:

a platform side of the platform defining a slot, the slot including a vertically oriented inner surface having a top end and a bottom end, an inner bottom surface extending from the bottom end of the vertically oriented inner surface, and an inner channel extending from the top end of the vertically oriented inner surface, the inner channel including an inner lip;

a ramp section of the ramp defining a support surface on a top side thereof and a downwardly extending support flange engagement structure extending from a bottom side thereof;

a support flange configured to be disposed between the platform side and the ramp section, the support flange including a longtitudinal body having a first side and a second side and a top end and a bottom end, a lip disposed at the top end of the body, a bottom surface at the bottom end of the body, and a flange section outwardly extending from a middle portion of the second side of the body, wherein the flange section includes an upwardly extending portion laterally spaced from the middle portion of the second side of the body defining a flange section receiver having an open top portion, wherein the support flange is rotatable and selectively mountable to, and selectively removable from, the slot of the platform side such that when the support flange is mounted to the platform side in the slot, the first side of the support flange is in contact with the vertically oriented inner surface of the slot, the bottom end of the flange aligns and is in contact with the bottom inner surface of the slot, and the lip of the support flange is in the inner channel of the slot and in contact with the inner lip of the inner channel, and such that when the support flange is being rotatably removed from the slot, the first side of the support flange is in contact with the vertically oriented inner surface of the slot, the bottom end of the flange is vertically spaced from the bottom inner surface of the slot, and the lip of the support flange is in the inner channel of the slot vertically spaced from the inner lip of the inner channel, wherein the support flange, when coupled to the platform side, is configured to support the ramp section via flange section receiver in a range of downward angles of the ramp section relative to the platform side by using an upward facing surface of the support flange to interface with a downward facing surface of the downwardly extending support flange engagement structure of the ramp section.

2. A ramp and platform assembly, comprising:

a platform having a substantially horizontal deck, wherein the deck is fixed in position and elevated compared to a reference ground surface, the platform including a platform side having a slot including a vertically oriented inner surface having a top end and a bottom end, a bottom inner surface extending from the bottom end of the vertically oriented inner surface, and an inner channel extending from the top end of the vertically oriented inner surface, the inner channel including an inner lip;

a ramp configured for coupling to the platform, wherein the ramp is configurable to extend at a downward angle from the platform to a surface at another elevation or to a ground surface, the ramp including a ramp section defining a support surface on a top side thereof and a downwardly extending support flange engagement structure extending from a bottom side thereof; and a support flange configured to be disposed between the platform and the ramp, wherein the support flange includes a longitudinal body having a first side and a second side and a top end and a bottom end, a lip disposed at the top end of the body, a bottom surface at the bottom end of the body, and a flange section outwardly extending from a middle portion of the second side of the body, wherein the flange section includes an upwardly extending portion laterally spaced from the middle portion of the second side of the body defining a flange section receiver having an open top portion, wherein the support flange is rotatably and selectively mounted to the platform side in the slot, such that when the support flange is mounted to the platform side in the slot, the first side of the support flange is in contact with the vertically oriented inner surface of the slot, the bottom end of the flange aligns is in contact the bottom inner surface of the slot, and the lip of the support flange is in the inner channel of the slot in contact with the inner lip of the inner channel, and such that when the support flange is being rotatably removed from the slot, the first side of the support flange is in contact with the vertically oriented inner surface of the slot, the bottom end of the flange is vertically spaced from the bottom inner surface of the slot, and the lip of the support flange is in the inner channel of the slot vertically spaced from the inner lip of the inner channel, wherein the support flange, when coupled to the platform side, is configured to support the ramp section via flange section receiver in a range of downward angles of the ramp section relative to the platform by using an upward facing surface of the support flange to interface with a downward facing surface of the downwardly extending support flange engagement structure of the ramp section.

3. The ramp and platform interface of claim 1, wherein the upward facing surface of the support flange is a concave surface.

4. The ramp and platform interface of claim 1, wherein the downward facing surface of the downwardly extending support flange engagement structure of the ramp section is a convex surface.

5. The ramp and platform interface of claim 1, wherein the ramp section can be decoupled from platform side when the ramp section is oriented in any of the plurality of downward angles.

6. The ramp and platform interface of claim 1, wherein the bottom surface of the body of the support flange and the inner bottom surface of the slot are both planar surfaces.

7. The ramp and platform interface of claim 1, wherein the bottom surface of the body of the support flange and the inner bottom surface of the slot are both horizontal surfaces.

8. The ramp and platform interface of claim 1, wherein the vertically oriented inner surface of the slot and the first side of the support flange are both planar surfaces.

9. The ramp and platform interface of claim 1, wherein the support flange engagement structure is spaced inwardly from an end of the ramp to minimize a gap between the ramp and the platform.

10. The ramp and platform assembly of claim 2, wherein the upward facing surface of the support flange is a concave surface.

11. The ramp and platform assembly of claim 2, wherein the downward facing surface of the downwardly extending support flange engagement structure of the ramp is a convex surface.

12. The ramp and platform assembly of claim 2, wherein the ramp can be decoupled from the platform when the ramp is oriented in any of the plurality of downward angles.

13. The ramp and platform assembly of claim 2, wherein the bottom surface of the body of the support flange and the inner bottom surface of the slot are both planar surfaces.

14. The ramp and platform assembly of claim 2, wherein the bottom surface of the body of the support flange and the inner bottom surface of the slot are both horizontal surfaces.

15. The ramp and platform assembly of claim 2, wherein the vertically oriented inner surface of the slot and the first side of the support flange are both planar surfaces.

16. The ramp and platform assembly of claim 2, wherein the support flange engagement structure is spaced inwardly from an end of the ramp to minimize a gap between the ramp and the platform.

* * * * *